United States Patent [19]

Gustine

[11] Patent Number: 5,031,812

[45] Date of Patent: Jul. 16, 1991

[54] GOLF BALL MARKER, CARRYING POUCH AND SUPPORT

[76] Inventor: Floyd L. Gustine, 5631 Curry Rd., Pittsburgh, Pa. 15236

[21] Appl. No.: 524,509

[22] Filed: May 17, 1990

[51] Int. Cl.[5] ..... A63B 57/00; A45F 5/00

[52] U.S. Cl. ..... 224/191; 224/918; 224/919; 224/226; 273/32 A; 273/DIG. 30; 206/315.5

[58] Field of Search ..... 273/32 A, 162 D, DIG. 30, 273/346, 282 R, 282 A, 282 B; 224/918, 919, 191, 226; 206/315.5

[56] References Cited

U.S. PATENT DOCUMENTS

| | | | |
|---|---|---|---|
| 3,895,797 | 7/1975 | Moore | 273/32 A |
| 3,938,805 | 2/1976 | Sakuma | 273/162 D |
| 3,967,823 | 7/1976 | Yount | 273/346 |
| 4,226,420 | 10/1980 | Corday | 273/DIG. 30 |
| 4,354,282 | 10/1982 | Langdon | 273/DIG. 30 |
| 4,498,615 | 2/1985 | Johnson | 224/918 |
| 4,632,389 | 12/1986 | Moss | 273/DIG. 30 |
| 4,736,955 | 4/1988 | Pollock | 273/DIG. 30 |
| 4,893,739 | 1/1990 | Conner | 224/918 |

*Primary Examiner*—George J. Marlo
*Attorney, Agent, or Firm*—William J. Ruano

[57] ABSTRACT

A golf ball position marker detachably secured to a supporting strip attached to a golfer's belt or golf bag. A pouch having a pair of tabs may be supported on the supporting strip, either by looping the tabs thereon or by attaching the tabs directly onto the supporting strip. Interpenetrating fibers are provided on coacting faces of the marker, supporting strip, and tabs, so that the marker and tabs may be detachably fastened to the supporting strip.

3 Claims, 2 Drawing Sheets

GOLF BALL MARKER, CARRYING POUCH AND SUPPORT

This invention relates to a golf ball position marker and support assembly on which the marker may be detachably secured.

BACKGROUND OF THE INVENTION

Golf ball position markers, as used in the past, have been ordinary coins taken from the pocket of the golfer, which have been found to be unsatisfactory since women golfers do not always have pockets and men golfers prefer more professional markers.

SUMMARY OF THE INVENTION

An object of the present invention is to overcome the abovenamed objections of markers used in the past by providing a novel type marker that is readily attachable and detachable from a support, which support may be in any one of a number of preferred locations.

A more specific object is to provide a marker having a Velcro base integrally attached thereto which enables attaching the marker to a corresponding Velcro base which may be located on the belt of the golfer, or any other of his clothes, or even on objects, such as a golf bag, golf club or the like.

DESCRIPTION OF THE PREFERRED EMBODIMENTS

Figures 1, 2, 3, 4, 5, 6:
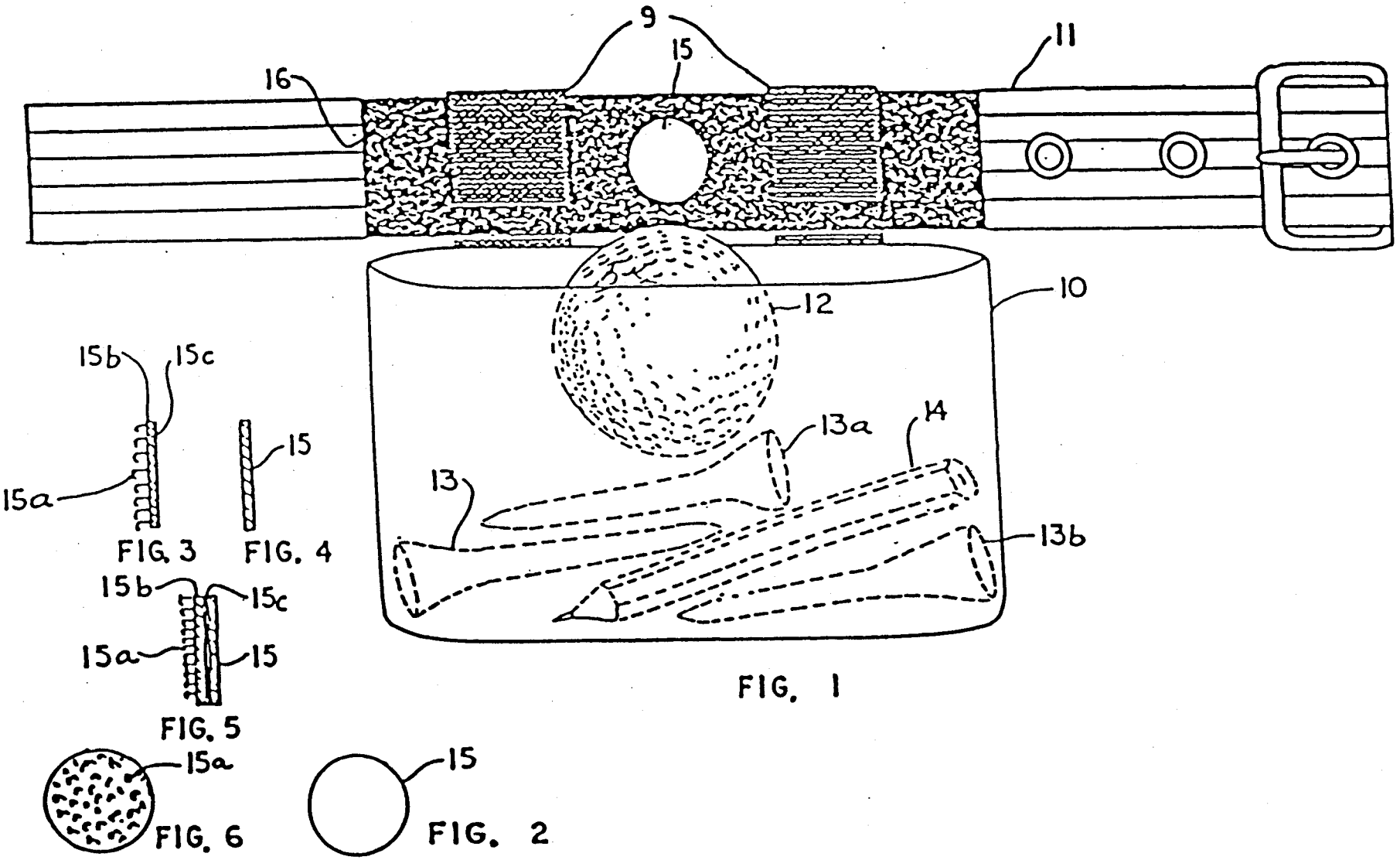
FIG. 1 is a plan view showing a golf ball position marker having a Velcro piece integrally attached to the rear thereof, which marker is detachably secured to a Velcro strip onto which a pouch is supported on a golfer's belt.
FIG. 2 is a front view of the golf ball position marker.
FIG. 3 is a cross sectional view of the golf ball position marker Velcro base.
FIG. 4 is a cross-sectional view of the golf ball position marker alone before attachment of a Velcro base.
FIG. 5 is a cross-sectional view of the golf ball position marker assembly.
FIG. 6 is a rear view of the Velcro attached golf ball position marker assembly.

Hook and loop fasteners, such as the type sold under the Velcro trademark of velcro USA Inc., Nutley, N.J., are used in a variety of fields. Referring to FIG. 4, numeral 15 denotes a golf ball position marker made of any suitable material, such as metal or plastic of any color, to which a Velcro backing 15*b* (FIG. 3) is integrally adhered by glue or any other adhesive material 15*c*

The Velcro backing is a weave of hook shape, 15*a* as shown in FIG. 1 in De Brabander U.S. Pat. No. 3,943,981 dated Mar. 16, 1976, incorporated herein by reference. The supporting backing strip 16 is of loop shape 8 shown in FIG. 2 in said patent to mate with or provide interpenetrating connection in a manner well known in the art. It should be understood that the reverse arrangement could be used, namely to make the back of the golf ball position marker of loop shape and its support of hook shape, if so desired.

Referring to FIG. 1, numeral 10 denotes a golfer's belt 11 which may have a Velcro strip 16 sewed onto or detachably secured to the belt's surface onto which the corresponding Velcro material, such as Velcro loops may be provided if the Velcro material of the golf ball position marker has hooks. Of course, these may be reversed by having hooks on the belt and loops on the marker base. If desired, the entire outer surface of the belt 11 may be of Velcro.

A pouch 10 has a pair of supporting tabs or extensions 9, 9 onto which is adhered a pair of Velcro pieces having hooks, so that when folded downwardly to overlap the Velcro loops of the belt, the Velcro pieces will interpenetrate the loops and engage to support the bag or pouch 10 on the golfer's belt 11. Since the packet or pouch is convenient for carrying golf balls 12, tees 13, 3*a*, 13*b* and pencil 14, it provides a convenient receptical for storing not only such items, but the marker shown in FIGS. 3–6. This is particularly the case since the golfer will usually carry the marker as well as the golf ball in his hand while on the greens and seek a place for storage. Marker 15 may be attached to strip 16.

The golfer could attach a Velcro strip having loops on any part of his clothing, or on the golf club or bag instead, if he does not have a pouch such as 10. The essence of the present invention is to enable the golfer to attach the golf ball position marker anywhere he chooses by simply attaching a Velcro piece there.

Figure 7:
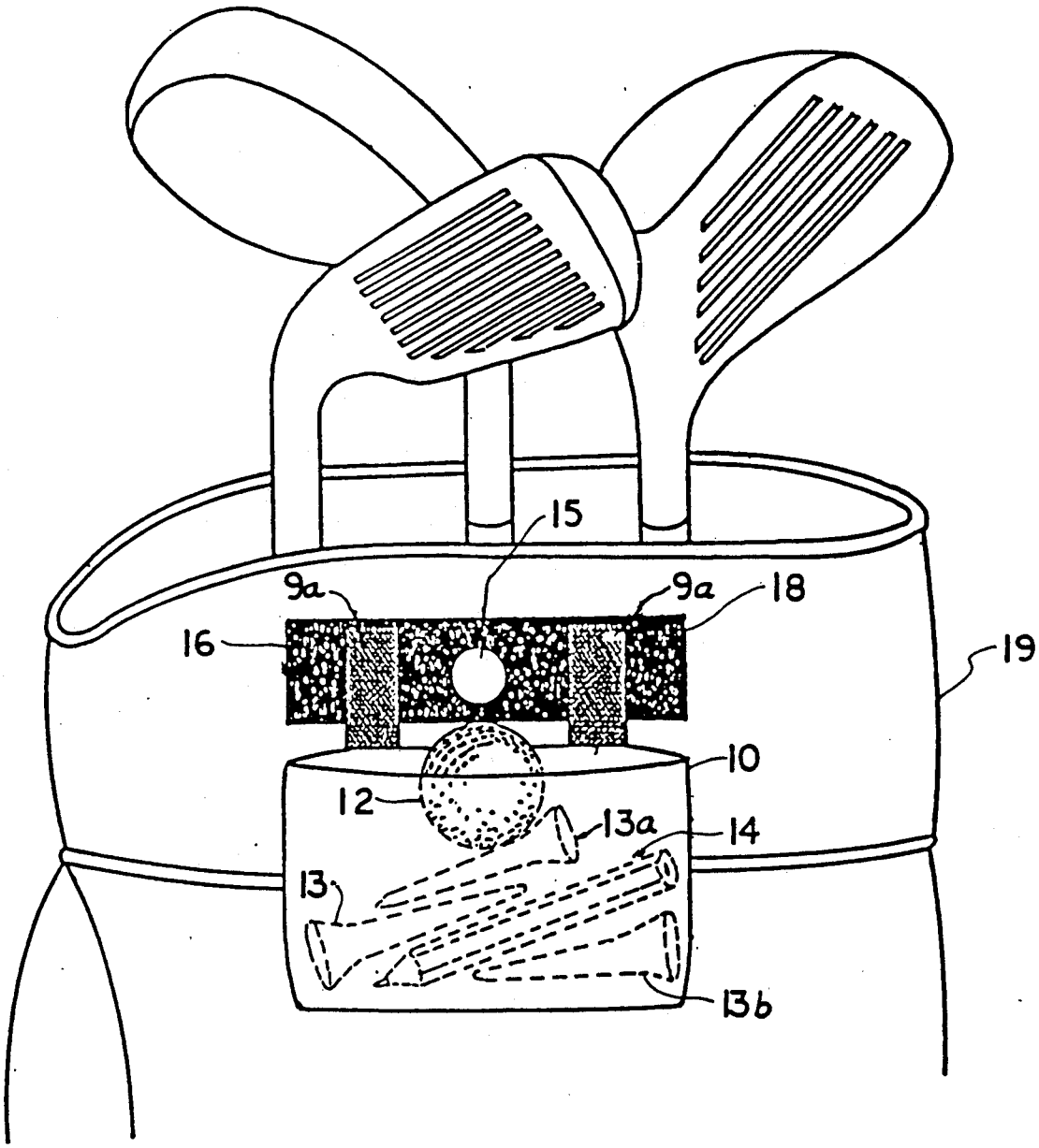
FIG. 7 is a front view of a modification of the assembly supported on a golf bag.

FIG. 7 shows a modification of the support for the pouch 10, namely, by having the Velcro strip 16 either detachably adhered or glued to a golf bag 19. The Velcro tabs 9*a*, 9*a* may be detachably secured directly onto Velcro strip 16.

Similarly, the bag may be detachably secured to any other object.

While I have illustrated and described several embodiments of my invention, it will be understood that these are by way of illustration only and that various changes and modifications are contemplated in my invention within the scope of the following claims:

I claim:

1. A golf ball position marker of solid disc shape devoid of any projections, a backing adhered thereto having a multiplicity of upstanding, interpenetrating fibers, a support for readily detachable attachment to said backing by having a multiplicity of upstanding, interpenetrating fibers, one of said multiplicity of upstanding interpenetrating fibers being in the form of loops and the other, in the form of hooks which hook onto said loops as the result of interpenetration, and a pouch attached to said support for carrying golf items.

2. The combination recited in claim 1 together with loop means for attaching said pouch to said support.

3. The combination recited in claim 2 wherein said loop means has a multiplicity of interpenetrating fibers for detachable fastening to those of said support.

* * * * *